US009482073B2

(12) United States Patent
Andrigo

(10) Patent No.: US 9,482,073 B2
(45) Date of Patent: Nov. 1, 2016

(54) CONVERTIBLE VALVE WITH RETAINED CONVERSION ELEMENT

(71) Applicant: TOP-CO INC., Weatherford, TX (US)

(72) Inventor: Gregory James Alexander Andrigo, Almonte (CA)

(73) Assignee: Top-Co Inc., Houston, TX (US)

( * ) Notice: Subject to any disclaimer, the term of this patent is extended or adjusted under 35 U.S.C. 154(b) by 26 days.

(21) Appl. No.: 14/750,275

(22) Filed: Jun. 25, 2015

(65) Prior Publication Data

US 2015/0377372 A1 Dec. 31, 2015

Related U.S. Application Data

(60) Provisional application No. 62/018,230, filed on Jun. 27, 2014.

(51) Int. Cl.

| | |
|---|---|
| ***E21B 34/06*** | (2006.01) |
| ***E21B 34/10*** | (2006.01) |
| *E21B 34/00* | (2006.01) |

(52) U.S. Cl.

CPC ..... *E21B 34/102* (2013.01); *E21B 34/10* (2013.01); *E21B 2034/002* (2013.01); *E21B 2034/005* (2013.01)

(58) Field of Classification Search

CPC ..... E21B 34/102; E21B 2034/002; E21B 2034/005; E21B 21/10

USPC ..... 137/68.17

See application file for complete search history.

(56) References Cited

U.S. PATENT DOCUMENTS

| | | | | |
|---|---|---|---|---|
| 2,768,695 | A * | 10/1956 | Althouse, Jr. | E21B 21/10 137/68.17 |
| 4,291,722 | A | 9/1981 | Churchman | |
| 5,048,611 | A | 9/1991 | Cochran | |
| 5,180,016 | A | 1/1993 | Ross et al. | |
| 8,955,543 | B2 * | 2/2015 | Groesbeck | E21B 21/10 137/513 |
| 2011/0168410 | A1 | 7/2011 | DeBoer | |
| 2011/0290344 | A1 | 12/2011 | Groesbeck | |

OTHER PUBLICATIONS

United States International Searching Authority; International Search Report & Written Opinion for PCT/US2015/037975; Sep. 30, 2015; 17 pages; Alexandria, VA; US.

* cited by examiner

*Primary Examiner* — Kevin Lee
*Assistant Examiner* — P. Macade Nichols
(74) *Attorney, Agent, or Firm* — Craig Steven Jepson; Anthony D. Seach; Reed & Scardino LLP

(57) ABSTRACT

A convertible valve having a conversion element retained in a seat to convert a valve gate from bidirectional flow to unidirectional flow. The convertible valve includes a valve gate moveable between a first open position and a second closed position, a seat moveable between a first position and a second position, and a conversion element retained in the seat. The seat, in its first position, maintains the valve gate in its first open position. With the valve gate in the first open position, the convertible valve allows bi-directional fluid flow. Fluid flowing through the convertible valve creates downward force on the conversion element and the seat. Upon reaching a predetermined force, the seat moves to its second position allowing the valve gate to move to its second closed position. With the valve gate in the second closed position, the convertible valve allows only unidirectional fluid flow.

6 Claims, 5 Drawing Sheets

CONVERTIBLE VALVE WITH RETAINED CONVERSION ELEMENT

CROSS-REFERENCE TO RELATED APPLICATIONS

This application claims priority to provisional application Ser. No. 62/018,230, filed Jun. 27, 2014, and titled Convertible Valve with a Retained Conversion Device, which is incorporated herein in its entirety by reference.

FIELD OF THE INVENTION

The invention relates to convertible valves that allow for initial bi-directional fluid flow and subsequent conversion to thereafter allow only unidirectional flow.

BACKGROUND OF THE INVENTION

Convertible valves are widely used in the oil and gas industry to provide controlled flow of fluids and slurries into vertical and horizontal wellbores. Most convertible valves rely on free floating or surface deployed occlusion devices or other trigger devices to convert the valves from bi-directional to unidirectional flow. However, as a result of the free floating or surface deployed occlusion device or trigger, the conventional valves have the potential to prematurely convert, which results in the inability to properly circulate fluids throughout the wellbore. Additionally, conventional valves can be unreliable and may not convert at all resulting in overfill or U-flow of fluids back up through the valve. Accordingly, improvements in the reliability and functionality of convertible valves are sought.

SUMMARY OF INVENTION

One aspect of the invention features, in some embodiments, a valve gate movable between a first open position and a second closed position; a seat movable between a first and second position; and a conversion element retained in the seat and responsive to fluid flow through the convertible valve by acting upon the seat to move the seat between the first and second position. The seat, when in the first position, maintains the valve gate in the first open position, and when the seat is moved to the second position, it allows the valve gate to move to the second closed position. As will be evident to one of ordinary skill in the art having the benefit of this summary, the valve gate may include a spring or other biasing element to move the valve gate from its first open position into its second closed position.

In one embodiment, the seat is a ball seat, dart seat, or collet. The seat may be any structure suitable for seating of the conversion element and capable of movement sufficient to allow the valve gate to move from its first open position to its second closed position.

In one embodiment, the conversion element is a ball or a dart. The conversion element may be any device capable of seating in the seat and additionally, in some embodiments, being extruded from the seat under pressure.

In another embodiment, the seat is retained in position relative to the valve by one or more shear devices. The shear device may be a shear screw, shear ring or shear pin, or any other device capable of shearing with a known or predetermined amount of force.

In another embodiment, the conversion element is retained in the seat by at least one of a pin, a ring, and an interference fit.

In various embodiments, the convertible valve contains at least one bi-directional fluid flow passage or "bypass" passage formed through the body of the seat. Alternatively, the at least one bi-directional fluid flow passage may be defined as a recess on the periphery of the seat, or be defined partially by the seat and conversion element or therebetween. Additionally, in these embodiments, the fluid flow passages allow the passage of fluids up to a first pressure, and fluid flow above the first pressure causes the conversion element to act upon the seat. This causes the seat to move from its first position to its second position, which in turn causes the valve gate to move from its first open position to its second closed position. For example, different configurations of fluid flow passages and shear devices can be selected to establish a predetermined fluid flow and pressure that will shear the shear devices to convert the valve.

In another embodiment, a second valve gate, movable between a first open position and second closed position, and a second seat, movable between a first and second position, are included downbore of the first valve gate and first seat. Upon the extrusion of the conversion element from the first seat, the conversion element lands in and acts upon the second seat to move the second seat between the first and second position. The second seat, when in the first position, maintains the second valve gate in the first open position, and when the second seat is moved to the second position, it allows the second valve gate to move to the second closed position. The first and second valve gates can be biased toward the respective second closed positions while still allowing passage of fluid in one direction.

Another aspect of the invention features, in some applications, a method of converting a valve. The method includes providing a convertible valve including a valve gate, a seat, and a conversion element retained in the seat. The method further includes passing a fluid through the convertible valve at a first pressure; and raising the fluid pressure to a second pressure, which causes the shear devices to shear, moving the seat, and allowing the valve gate to close.

In some applications, the method includes attaching a second convertible valve downbore from the first valve; extruding the conversion element from the seat of the first convertible valve; and landing the conversion element in the second seat, which causes the shear devices to shear, moving the second seat, and allowing the second valve gate to close.

Another aspect of the invention includes a method of manufacturing a convertible valve. The method includes providing a valve body, a main housing, a valve gate, a seat, and a conversion element. The method further includes attaching the valve gate to the valve body, attaching the seat to the main housing, and retaining the conversion element in the seat. The method further includes attaching the valve body, with attached valve gate, to the main housing containing the seat and conversion element. The valve body and main housing are attached in a way that allows the seat, when in a first position, to maintain the valve gate in its open position, and the seat, when moved to its second position, allows the valve gate to move to its closed position.

In some applications the method includes attaching the seat to the main housing by at least one shear device.

In some applications the method includes retaining the conversion element in the seat by pin, ring, snap fit, or interference fit.

In some applications the method includes forming at least one bi-directional fluid flow passage in the seat. In some applications, the bi-directional fluid flow passage may be formed in the conversion element.

DETAILED DESCRIPTION

The following description is of exemplary embodiments of the invention only, and is not intended to limit the scope, applicability, or configuration of the invention. Rather, the following description is intended to provide a convenient illustration for implementing various embodiments of the invention. As will become apparent, various changes may be made in the function and arrangement of the elements described in these embodiments without departing from the scope of the invention set forth herein. It should be appreciated that the description herein may be adapted to be employed with alternatively configured devices having different shapes, components, mechanisms and the like and still fall within the scope of the present invention. It will be appreciated that such adaptations might be complex and time-consuming, but would nevertheless be a routine undertaking for those of ordinary skill in the art having the benefit of this description. Thus, the detailed description herein is presented for purposes of illustration only and not of limitation.

Figure 1B:
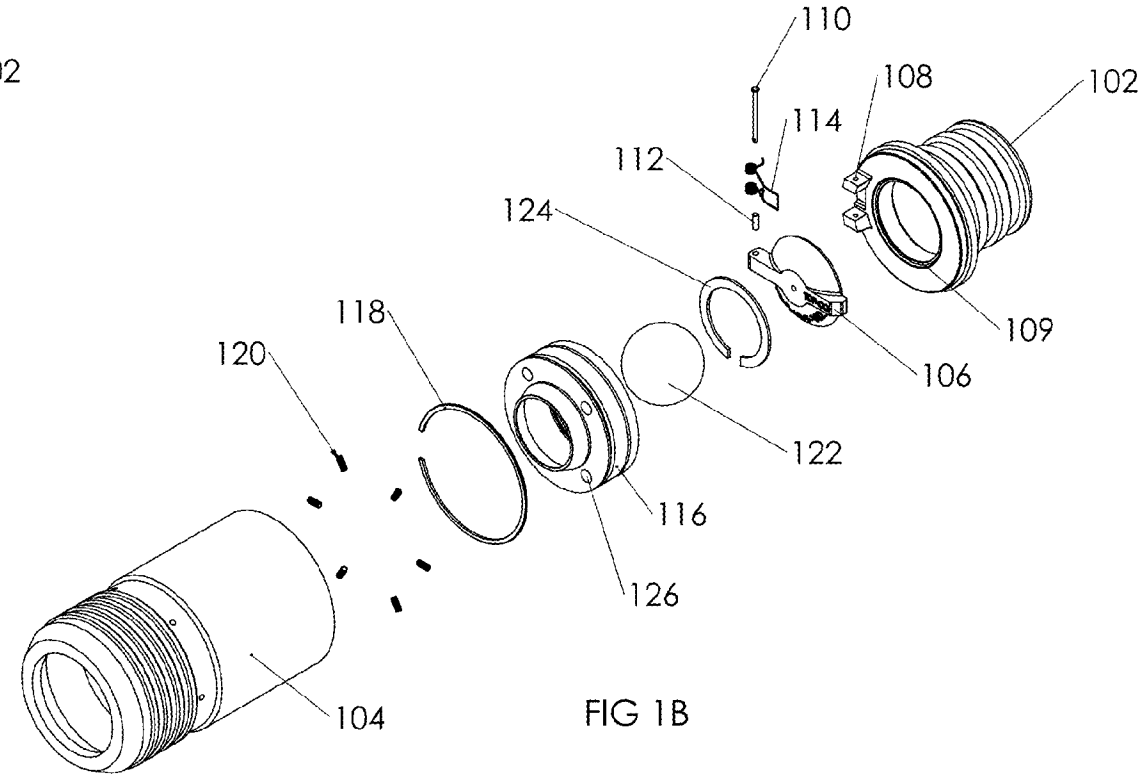
FIG. 1B shows an exploded view of one embodiment of a singular convertible valve, revealing, among other parts, the shear devices and conversion element retaining ring.
Figure 1A:
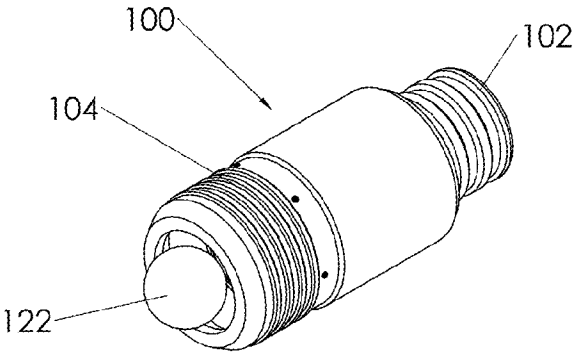
FIG. 1A shows an assembled view of one embodiment of a singular convertible valve.

With reference to FIG. 1A, an assembled view of a convertible valve 100 including a valve body 102 and main housing 104 couplable to a pipe string, sub, or other pipe section (not shown). FIG. 1B depicts an exploded view of components used in assembling a particular embodiment of convertible valve 100. In this embodiment, valve body 102 includes a mounting bracket 108 for the mounting of a valve gate 106, and a circular seal 109 to sealingly engaging valve gate 106 when in its closed position. Valve gate 106 is attached to valve body 102 by a pin 110 and bushing 112 mount, which also houses a metallic spring 114 that operates to move valve gate 106 between its open and closed positions. Valve body 102 and valve gate 106 are attached as an assembly to main housing 104.

Within main housing 104, valve gate 106 is initially retained in its open position by a seat 116. Seat 116 is retained in main housing 104 by a retaining ring 118 surrounding seat 116 and at least one shear device 120; shear device(s) 120 extending through main housing 104 and into seat 116. Shear device(s) 120 may be any type of shear device, including, e.g., screws and pins. The interior of seat 116 is designed so that a conversion element 122, depicted as a conversion ball in FIG. 1A and FIG. 1B, is retained therein by a snap ring 124 or other suitable retainer. It is further contemplated that other methods of retaining conversion element 122 in seat 116 are possible, including the use of adhesives, snap fits, interference fits and the like. Seat 116 has at least one bi-directional fluid passage 126 formed in the body of seat 116. Bi-directional fluid passage 126 allows passage of fluids up to a first pressure, and pressures above the first pressure cause conversion element 122 to act upon seat 116 to move seat 116 between a first and second position, thus allowing movement of valve gate 106 in the second position.

Figure 2B:
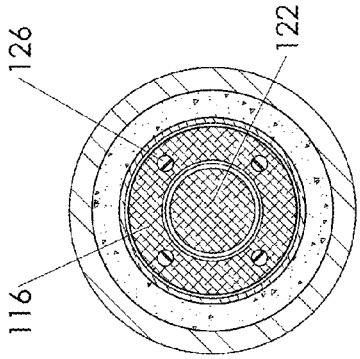
FIG. 2B shows a partial top view taken along line BB of FIG. 2A; showing the seat, conversion element, and bi-directional fluid passages.
Figure 2A:
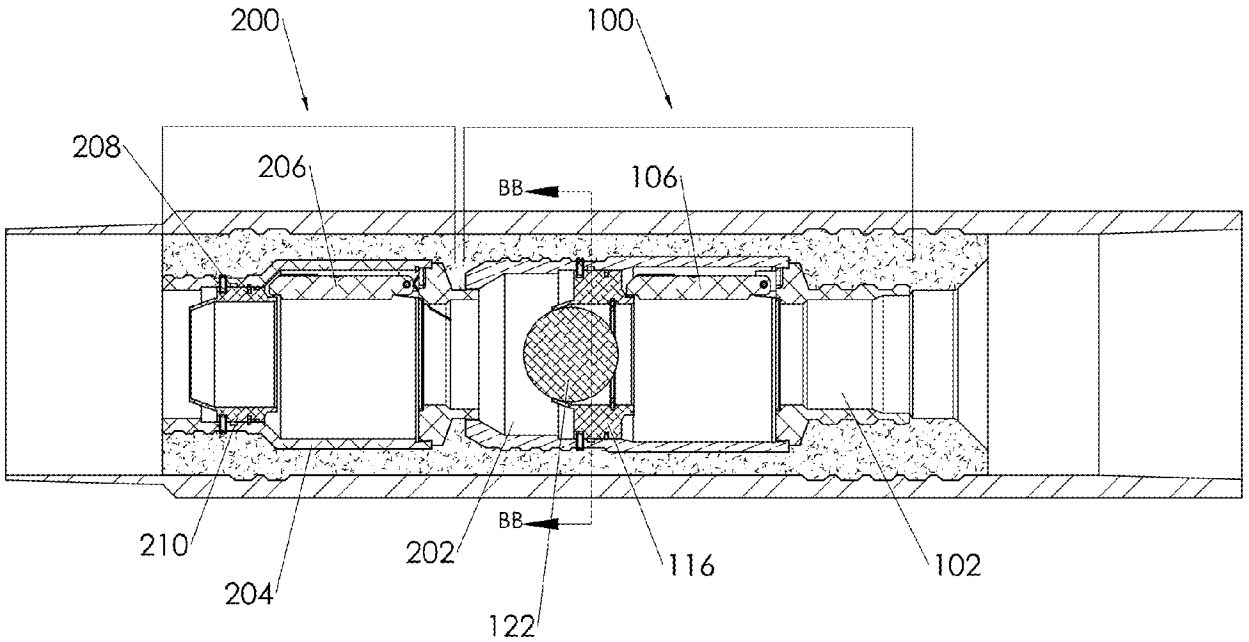
FIG. 2A shows a cross-sectional side view of one embodiment of dual convertible valves.

FIG. 2A shows a cross-sectional view of another embodiment of the device. In this embodiment, attached to the lower end of main housing 104, is a second convertible valve 200. Second convertible valve 200 includes a second valve body 202 and second main housing 204 couplable to a pipe string, sub, or other convertible valve. Second valve body 202 includes a second valve gate 206. Second valve gate 206 can be mounted within second valve body 202 in a similar fashion as valve gate 106 is mounted within valve body 102. The second valve body 202 and second valve gate 206 are depicted as an assembly attached to second main housing 204, but could readily be integrated with valve body 102 and valve gate 106 within a common main housing (not shown).

Within second main housing 204, second valve gate 206 is retained in its open position by a second seat 208. Second seat 208 can be retained in second main housing 204 in a similar fashion as seat 116 is retained in main housing 104, e.g., including shear device(s) 210 extending through second main housing 204 and into second seat 208. However, second seat 208 need not define fluid passages since second convertible valve 200 is generally to be converted upon landing of conversion element 122 on second seat 208 following conversion of convertible valve 100 and extrusion of conversion element 122 from seat 116.

FIG. 2B provides a partial top view taken along line BB of FIG. 2A showing seat 116, conversion element 122, and one possible location for bi-directional fluid passage(s) 126. In FIG. 2B bi-directional fluid passage(s) 126 are located through the body of seat 116.

When properly assembled and connected to a pipe string, the device functions by allowing fluids to be pumped through the valve assembly by flowing through valve body 102, through fluid passages 126 defined in seat 116, through second valve body 202, and out through second seat 208. Due to the design of convertible valves 100 and 200, and fluid passages 126, fluid flow is initially possible in a bi-directional manner so as to allow the circulation of fluids throughout a pipe string. The device may be converted by raising the fluid pressure to a certain predetermined pressure to then allow only unidirectional flow. Upon reaching the predetermined pressure, conversion element 122 will apply downward force to seat 116 in which it is retained, sufficient to shear one or more shear device(s) 120 and move seat 116 into a second position. With seat 116 in this second position, valve gate 106 is free to move towards a biased closed position, thereafter effectively serving as a one-way flapper valve.

Further pressurization causes conversion element 122 to be extruded from seat 116. Conversion element 122 travels through second valve body 202, and lands in second seat 208. Conversion element 122 then occludes the central fluid passage of second seat 208 and applies downforce sufficient to similarly shear one or more shear device(s) 210 holding second seat 208. Upon this shearing, second seat 208 moves into the second position, thus allowing second valve gate 206 to move towards a biased-closed position. It is important to note that upon the conversion of one or both valve gates 106 and 206, fluids will no longer be able to back flow through the valves, i.e. in the direction from second seat 208 through second valve body 202. However, after conversion of one or both valve gates 106 and 206, down-bore fluid flow is still possible, i.e., through the device in the direction from convertible valve 100 to second convertible valve 200.

Figures 3A, 3B:
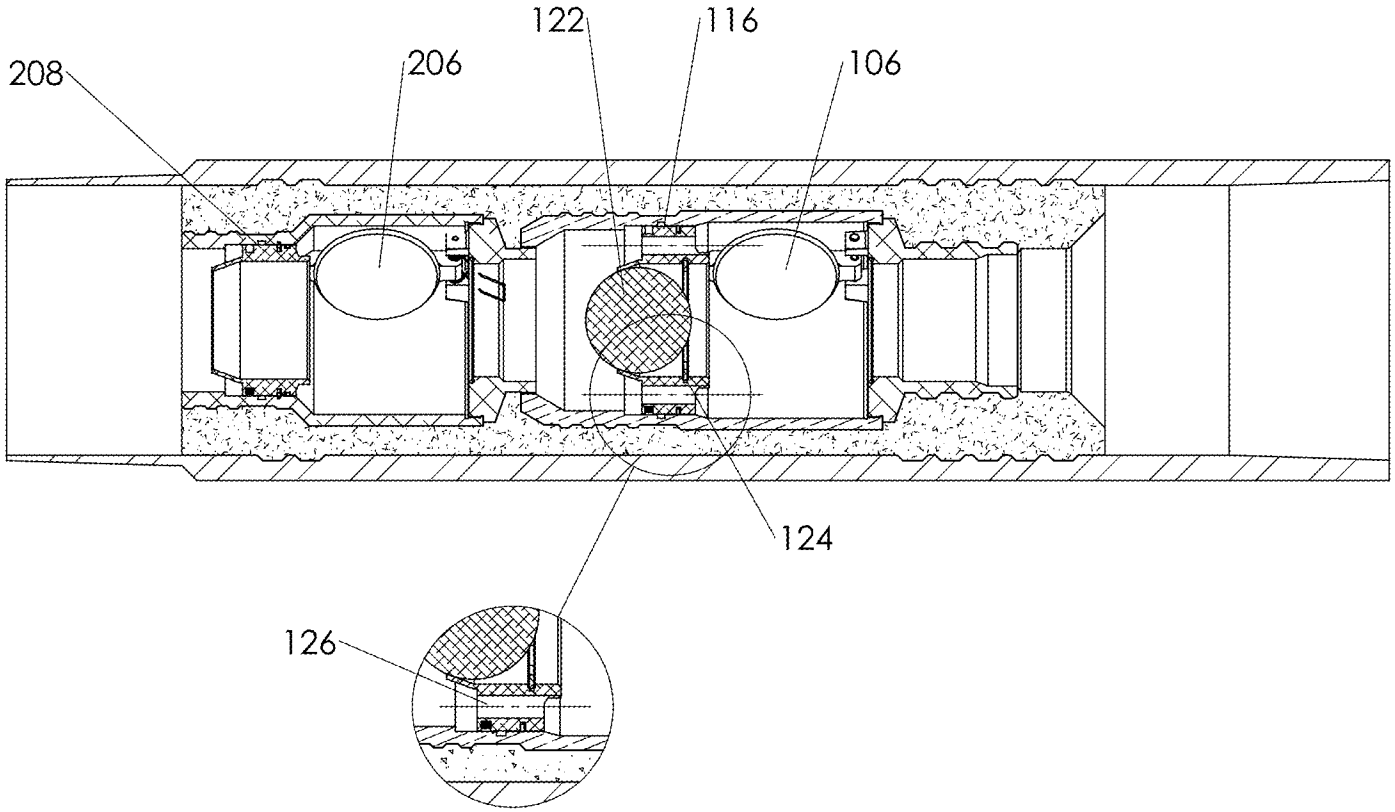
FIG. 3A shows a rotated cross-sectional view of one embodiment of convertible valves.
FIG. 3B shows a close-up view of the seat and conversion element with the bi-directional fluid flow passage depicted.

FIG. 3A shows the embodiment of FIG. 2A with an approximate forty-five degree rotation of the device. FIG. 3B provides a detailed view of one possible location for bi-directional fluid passage(s) 126, in this instance, being located through the body of seat 116. In other embodiments, bi-directional fluid passages or other limited "bypass" passages may be provided alternatively or additionally in other components such as valve body 102 and conversion element 122.

Figures 4A, 4B, 4C, 4D:
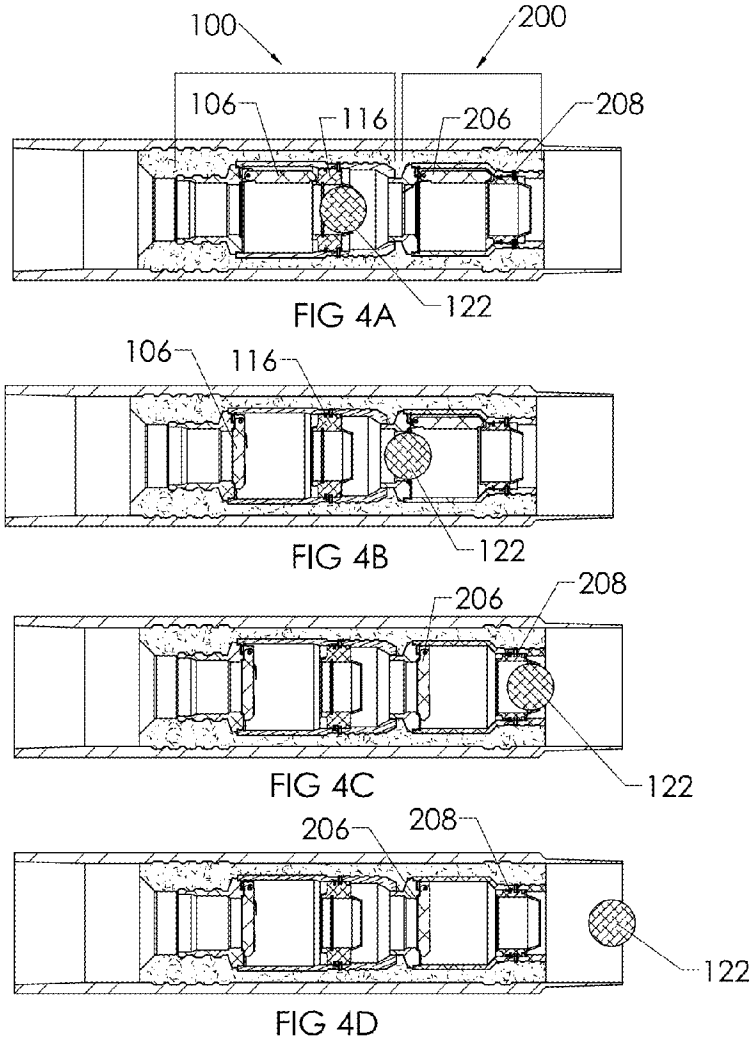
FIG. 4A shows a cross-sectional view of one embodiment of the convertible valves with the conversion element retained in the first seat.
FIG. 4B shows a cross-sectional view of one embodiment of the convertible valves with the first valve gate in a converted state and the conversion element being extruded from the first seat.
FIG. 4C shows a cross-sectional view of one embodiment of convertible valves with the second valve gate in a converted state.
FIG. 4D shows a cross-sectional view of one embodiment of convertible valves with the conversion element ejected from the second seat.
Figure 5D:
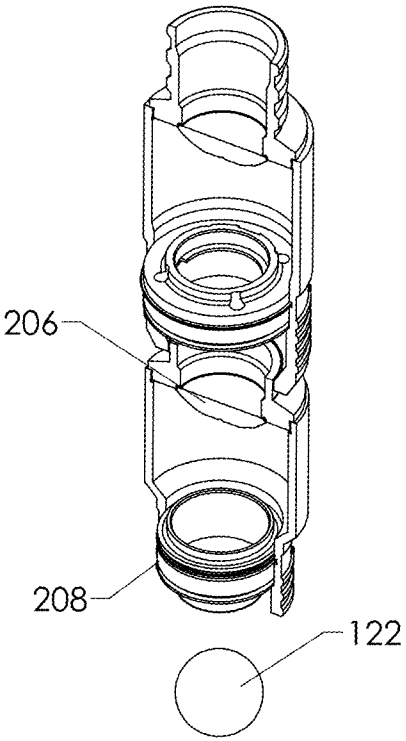
FIG. 5D shows a cross-sectional perspective view of one embodiment of dual convertible valves with the conversion element ejected from the second seat.
Figure 5C:
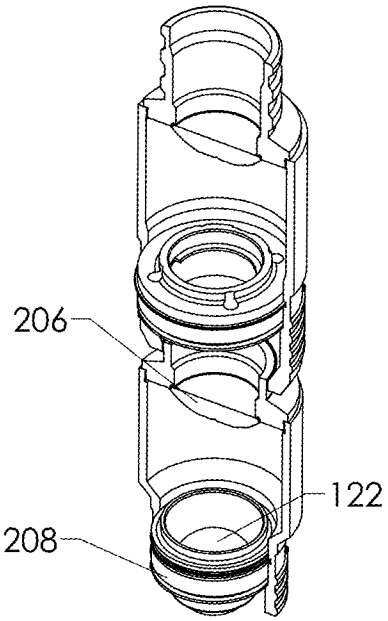
FIG. 5C shows a cross-sectional perspective view of one embodiment of dual convertible valves with the second valve gate in a converted state.
Figure 5B:
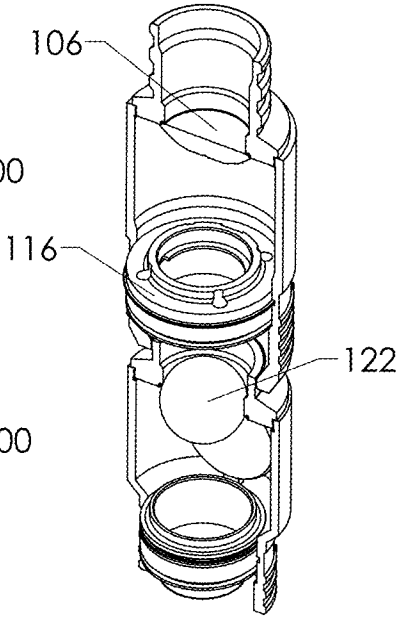
FIG. 5B shows a cross-sectional perspective view of one embodiment of dual convertible valves with the first valve gate in a converted state and the conversion element extruded from the second seat.
Figure 5A:
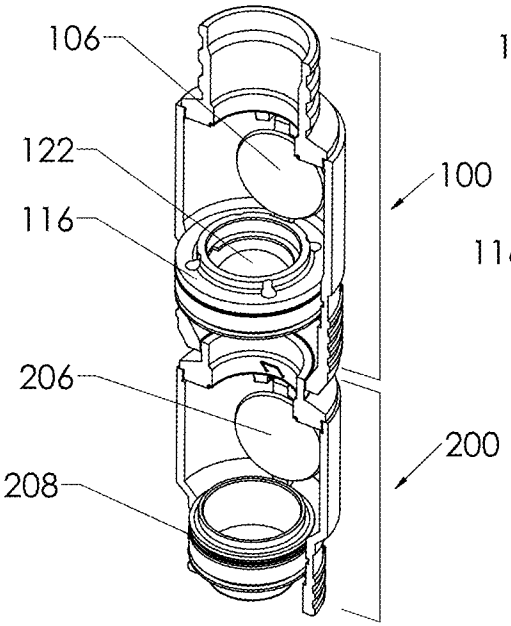
FIG. 5A shows a cross-sectional perspective view of one embodiment of dual convertible valves.

With reference to FIGS. 4A-4D and FIGS. 5A-5D, these figures show different cross-sectional views of various stages or states in the process of converting convertible valve 100 and second convertible valve 200. FIG. 4A and FIG. 5A reflect convertible valves 100 and 200 in unconverted states, similar to the depiction in FIG. 2A and FIG. 3A. As discussed above, when fluid flow through convertible valve 100 is raised beyond a predetermined pressure threshold, conversion element 122 causes seat 116 to shift to its second position, allowing valve gate 106 to move to its closed position, and causing conversion element 122 to be extruded through seat 116. This step is best depicted in FIG. 4B and FIG. 5B. Conversion element 122 then lands and seats onto second seat 208 where it acts upon second seat 208 in a similar fashion to allow second valve gate 206 to move to its closed position, as depicted in FIG. 4C and FIG. 5C. FIG. 4D and FIG. 5D depict one embodiment of the invention where after converting second valve gate 206, conversion element 122 is extruded from second seat 208 and released down-bore beyond second seat 208.

While several of the above-discussed figures depict sets of convertible valves, it is possible that many of the benefits of the invention can be obtain using a singular convertible valve, e.g., as depicted in FIG. 1A and FIG. 1B. For example, the reliability of the current invention may afford use of a singular convertible valve where multiple valves may have previously been required, depending upon the particular application and environmental conditions.

Note that in the various embodiments described herein, valve gates 106 and 206, seats 116 and 208, conversion element 122, valve bodies 102 and 202, and main housings 104 and 204 may each be composed of various materials including, but not limited to, aluminum, steel, cast iron, zinc alloys, plastic composite, and fiberglass composite.

Finally, while the present invention has been described above with reference to various exemplary embodiments, many changes, combinations and modifications may be made to the exemplary embodiments without departing from the scope of the present invention. For example, the various components may be implemented in alternative ways. These alternatives can be suitably selected depending upon the particular application or in consideration of any number of factors associated with the operation of the device. In addition, the techniques described herein may be extended or modified for use with other types of devices. These and other changes or modifications are intended to be included within the scope of the present invention.

What is claimed is:

1. A convertible valve comprising:

a valve gate movable between a first open position and a second closed position;

a seat movable between a first position and a second position, wherein said seat, in said first position, maintains said valve gate in said first open position, and wherein said seat, in said second position, allows said valve gate to move into said second closed position;

a conversion element retained in said seat, responsive to fluid flow through said convertible valve by acting upon said seat to move said seat between said first position and said second position; and at least one bi-direction fluid flow passage allowing passage of fluids up to a first pressure, wherein passage of fluids above said first pressure causes said conversation element to act upon said seat to move said seat between said first position and said second position to allow movement of said valve gate from said first open position to said second closed position, and wherein said at least one bi-directional fluid flow passage is formed through a body of said seat.

2. A convertible valve comprising:

a valve gate movable between a first open position and a second closed position;

a seat movable between a first position and a second position, wherein said seat, in said first position, maintains said valve gate in said first open position, and wherein said seat, in said second position, allows said valve gate to move into said second closed position;

a conversion element retained in said seat, responsive to fluid flow through said convertible valve by acting upon said seat to move said seat between said first position and said second position; and at least one bi-direction fluid flow passage allowing passage of fluids up to a first pressure, wherein passage of fluids above said first pressure causes said conversation element to act upon said seat to move said seat between said first position and said second position to allow movement of said valve gate from said first open position to said second closed position, and wherein said at least one bi-directional fluid flow passage is defined as a recess on a periphery of said seat.

3. A convertible valve comprising:

a valve gate movable between a first open position and a second closed position;

a seat movable between a first position and a second position, wherein said seat, in said first position, maintains said valve gate in said first open position, and wherein said seat, in said second position, allows said valve gate to move into said second closed position;

a conversion element retained in said seat, responsive to fluid flow through said convertible valve by acting upon said seat to move said seat between said first position and said second position; and at least one bi-direction fluid flow passage allowing passage of fluids up to a first pressure, wherein passage of fluids above said first pressure causes said conversation element to act upon said seat to move said seat between said first position and said second position to allow movement of said valve gate from said first open position to said second closed position, and wherein said at least one bi-directional fluid flow passage is at least partially defined between said seat and said conversion element.

4. A convertible valve comprising:

a valve gate movable between a first open position and a second closed position;

a seat movable between a first position and a second position, wherein said seat, in said first position, maintains said valve gate in said first open position, and wherein said seat, in said second position, allows said valve gate to move into said second closed position;

a conversion element retained in said seat, responsive to fluid flow through said convertible valve by acting upon said seat to move said seat between said first position and said second position;

a second valve gate movable between a first open position and a second closed position;

a second seat movable between a first position and a second position, wherein said second seat, in said first position, maintains said second valve gate in said first open position, and wherein said second seat, in said second position, allows said second valve gate to move into said second closed position; and wherein said conversion element is extrudable from said seat and receivable in said second seat to cause said conversion element to act upon said second seat to move said second seat between said first position and said second position to allow movement of said second valve gate from said first open position to said second closed position.

5. The convertible valve of claim 4, wherein said conversion element is extrudable from said second seat.

6. A method of converting a valve comprising:

providing a first convertible valve, including a valve gate movable between a first open position and a second closed position, a seat movable between a first position and a second position, at least one shear device, and a conversion element retained in said seat;

passing a fluid through said first convertible valve at a first pressure;

raising said fluid pressure to a second pressure to cause said shear device to shear, moving said seat from said first position to said second position, and allowing said valve gate to move from said first open position to said second closed position;

attaching a second convertible valve, including a second valve gate moveable between a first open position and a second closed position, a second seat moveable between a first position and a second position, and at least one second shear device, downbore from a first convertible valve;

extruding the conversion element from said seat of said first convertible valve;

landing the conversion element in said second seat;

causing said second shear device to shear to allow movement of said second seat from said first position to said second position; and allowing said second valve gate to move from said first open position to said second closed position.

* * * * *